US006664994B2

(12) United States Patent
Kyogoku et al.

(10) Patent No.: US 6,664,994 B2
(45) Date of Patent: Dec. 16, 2003

(54) RECORDING APPARATUS, RECORDING METHOD, AND STORAGE MEDIUM

(75) Inventors: Hiroshi Kyogoku, Yokohama (JP); Takashi Sasaki, Chigasaki (JP); Yoshinobu Shiraiwa, Machida (JP); Kenji Takahashi, Tokyo (JP); Shinya Hirai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 119 days.

(21) Appl. No.: 09/945,724

(22) Filed: Sep. 5, 2001

(65) Prior Publication Data

US 2002/0051027 A1 May 2, 2002

Related U.S. Application Data

(62) Division of application No. 09/240,845, filed on Feb. 1, 1999.

(30) Foreign Application Priority Data

Feb. 2, 1998 (JP) ..... 10-020858
Jun. 25, 1998 (JP) ..... 10-178981

(51) Int. Cl.[7] ..... B41J 2/325
(52) U.S. Cl. ..... 347/215
(58) Field of Search ..... 347/215, 217, 347/218, 176, 185; 400/120.08; 399/45; 358/296

(56) References Cited

U.S. PATENT DOCUMENTS

| | | | | |
|---|---|---|---|---|
| 5,418,554 A | | 5/1995 | Kiguchi et al. | 347/215 |
| 5,432,532 A | | 7/1995 | Mochimaru et al. | 347/176 |
| 5,574,551 A | | 11/1996 | Kazakoff | 399/45 |
| 6,313,858 B1 | * | 11/2001 | Kyogoku et al. | 347/215 |

FOREIGN PATENT DOCUMENTS

| | | |
|---|---|---|
| EP | 0 304 803 | 3/1989 |
| EP | 0 534 794 | 3/1993 |
| EP | 0 557 137 | 8/1993 |
| EP | 0 600 593 | 6/1994 |
| EP | 0 658 853 | 6/1995 |
| EP | 0 665 115 | 8/1995 |
| JP | 6-30922 B2 | 1/1986 |

* cited by examiner

*Primary Examiner*—Lamson Nguyen
*Assistant Examiner*—K. Feggins
(74) *Attorney, Agent, or Firm*—Fitzpatrick, Cella, Harper & Scinto

(57) ABSTRACT

A recording apparatus, which uses an ink sheet having ink of plural colors coated sequentially thereon and transferring ink to a recording medium for recording in accordance with image data, is capable of recording on a plurality of recording media having different sizes, at the same time, being capable of using selectively plural ink sheets each corresponding to each of the plural recording media of different sizes. This recording apparatus comprises a device for detecting the size of a recording medium to detect the size of the recording medium to be used for recording; a device for detecting the size of an ink sheet to detect the size of a recording medium corresponding to the ink sheet to be used for recording; and controlling a device to control the recording operation in accordance with the size of the detected recording medium and the size of the recording medium corresponding to the detected ink sheet. With these devices thus arranged, it is made possible to record without recording improperly any smaller images that may be unfit for the size of the recording sheet or staining the platen and others in the interior of the apparatus even when the recording medium and the ink sheet installed thereon are different in its sizes or the user does not designate the size of the recording medium to be used.

20 Claims, 6 Drawing Sheets

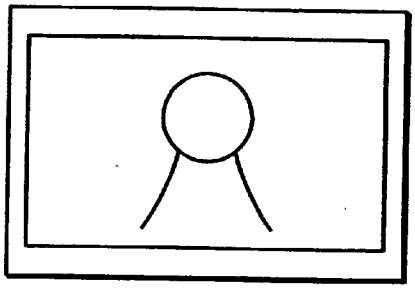
FIG. 5A
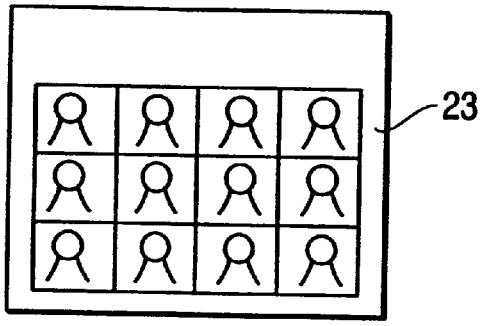
FIG. 5B
FIG. 6
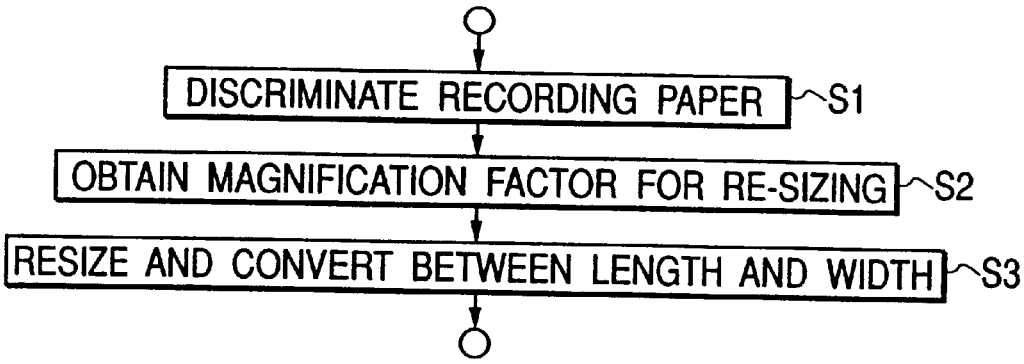

FIG. 10A

[MENU]

| | | | |
|---|---|---|---|
| 1 | PRINTED NUMBER OF SHEETS | [1] | N |
| 2 | MULTI-SCREEN | [1] | N |
| 3 | IMAGE INSERTION | [NO] | YES |
| 4 | PANORAMA | [NO] | YES |
| 5 | TITLE | [NO] | YES |
| 6 | ADJ OF IMAGE QUALITY | [NO] | YES |
| 7 | | | |
| ⋮ | | | |

FIG. 10B

A

[MENU] SEAL

| | | |
|---|---|---|
| PRINTED NUMBER OF SHEETS | [1] | N |
| MULTI-SCREEN | 1 | [16] |
| IMAGE INSERTION | NO | [YES] |
| PANORAMA | [NO] | YES |
| TITLE | [NO] | YES |
| ADJ OF IMAGE QUALITY | [NO] | YES |

FIG. 10C

A

[MENU] HALF SIZE

| | | |
|---|---|---|
| PRINTED NUMBER OF SHEETS | [1] | N |
| MULTI-SCREEN | [1] | N |
| IMAGE INSERTION | [NO] | YES |
| PANORAMA | [NO] | YES |
| TITLE | [NO] | YES |
| ADJ OF IMAGE QUALITY | [NO] | YES |

RECORDING APPARATUS, RECORDING METHOD, AND STORAGE MEDIUM

This is a divisional application of Application Ser. No. 09/240,845, filed Feb. 1, 1999.

BACKGROUND OF THE INVENTION

1. Field of the Invention

The present invention relates to a recording apparatus that records images on a recording medium by use of an ink sheet having the coating of thermal sublimation ink, thermal fusion ink or the like on it. More particularly, the invention relates to a recording apparatus capable of recording appropriate images in accordance with each size of recording sheets serving as a recording medium and ink sheets used for recording, as well as to relate to a recording method and a storage medium therefor.

The invention also relates to a recording apparatus capable of forming appropriate images in accordance with the respective kinds of recording sheets when recording sheets of different sizes or specially treated recording sheets are used, as well as to a recording method and a storage medium therefor.

2. Related Background Art

In recent years, video cameras, digital cameras, and the like have been used widely. Along with the popularization of such equipment which is capable of recording images, the demand for color printers has become increasingly more as a recording apparatus that can output the photographed and stored images on a recording medium, such as a recording sheet.

As recording methods of color images, there have been known various ones, among some others, such as the ink jet method for recording by discharging ink, the electronic photographing method for forming images by use of toner, the thermal transfer method for transferring ink to a recording medium by the application of thermal energy with an ink sheet having ink coated on it. Also, of the thermal transfer methods, there have been known a thermal fusion type that uses an ink sheet coated with ink which is fused when heat is applied, and a thermal sublimation type that uses an ink sheet coated with ink which is sublimated when heat is applied, and so on.

Of the various recording methods, the recording apparatus that adopts the thermal transfer method using the ink sheet makes it easier to maintain the apparatus. Here, particularly, the sublimation type transfer method facilitates the formation of full color images of the higher quality which is equal to that of a silver salt photography. Also, there is inevitably a need for the transfer method using the ink sheet to adopt an ink sheet corresponding to the size of a recording sheet used for recording. Therefore, this method is suitable for a recording apparatus that records on a recording sheet of comparatively small size.

When an image, which is obtained using an equipment, such as a video camera, should be output on a recording sheet, the recording sheet of comparatively small size is mainly used often. The output images should desirably be recorded in the higher quality equal to that of a silver salt photography. Here, therefore, the aforesaid thermal transfer type recording apparatus is anticipated to function as a color printer adoptable as output means of the video camera, digital camera, or the like.

In general, the recording sheets are housed in a sheet feed cassette or set in a sheet feed unit of the thermal transfer type recording apparatus. Then, each of the recording sheets is picked up by the rotation of a sheet feed roller to carry it to the recording unit. Here, the thermal head installed in the recording unit is driven with respect to the recording sheet thus carried to this unit in a state where the thermal head is pressed to the platen through the ink sheet and the recording sheet as well. In this way, the ink which is coated on the ink sheet is transferred to the recording sheet for recording images on it.

Here, depending on the user of a recording apparatus, the sizes of images to be recorded, the sizes of recording sheets on which the images should be output, and the kinds of recording sheets to be used for recording may differ variously. Therefore, it is desired to provide a recording apparatus capable of recording on various sizes and kinds of recording sheets as the case may be.

Also, for the aforesaid thermal transfer type recording apparatus, it is generally practiced to use ink sheet having ink of plural colors coated on each of them sequentially for recording a color image. Then, there has been known a method whereby to arrange the area on which ink of each color is coated corresponding to the size of a recording sheet to be used, hence preventing the wasteful consumption of ink sheets.

As has been described, the user should select the size of a recording sheet and set on a recording apparatus the ink sheet which corresponds to the size of that particular recording sheet used for recording when he intends to output an image in a desired size using such recording apparatus that may be able to deal with a plurality of recording sheets of different sizes.

For the recording apparatus that may be able to deal with a plurality of recording sheets of different sizes, it is generally known to select a recording sheet and execute the recording control in accordance with the size of recording sheet thus selected by the designation which is made by the user through his key entry or the like. However, if the user inputs an erroneous designation or forget inputting designation, the resultant recording is not made on the recording sheet as he has intended. Thus, the recording sheets are wastefully used after all. Particularly, for the aforesaid thermal sublimation type recording apparatus, it is usual to adopt recording sheets dedicated for its use in order to attain the higher quality recording. As compared with an ordinary sheet, this specially treated recording sheet is expensive, and it costs the user more if the recording sheets are wastefully used. Also, when recording is made on a recording sheet whose size is smaller than the size of the image that should be recorded, ink adheres to the platen in the recording apparatus and to the circumference thereof, because recording is made even on the portion where no recording sheet is present. Hence, there is a possibility that the recording sheet used for the next recording is stained by the adhesion of such ink.

In the specification of Japanese Patent Publication 06-030922, a method is proposed to automatically determine the size of an image to be recorded by the detection of a recording sheet both in length and breadth when recorded with the arrangement of an array sensor dedicated for this use, which is installed on the carry path of the recording sheet. However, the arrangement of this method is such that while an expensive array sensor is provided, the image is resized automatically without giving any caution or issuing any warning to the user in this particular aspect. Also, in some cases, a print-out, which is not needed, may be made eventually.

As described above, for the recording apparatus capable of using, by an appropriate selection, recording sheets of different sizes and ink sheets having different sizes, each corresponding to a recording sheet to be used, there are such problems that when the size of a recording sheet used for recording is not in agreement with the size of an ink sheet to be used, when the sheet feed cassette is carelessly replaced, or when the user forgets designating the size of a recording sheet to be used, images are not recorded suitably and the interior of the recording apparatus may be stained inevitably.

It is also desired to provide a recording apparatus capable of recording on a recording sheet (hereinafter referred to as a seal sheet) having a adhesive layer on it. The recording sheet is peeled off from the base sheet to make its adhesion to some other object possible so that the recorded image can be used as a seal. When recording is made on such seal sheet, it is desirable to edit or process the image in various ways in order to enhance the value thereof as a seal. As such edit or process of an image of the kind, there are cited a process in which a new image is formed by allowing some other image or characters to be overlaid on such image, a process in which images are contracted and arranged one after another so that a plurality of images can be arranged on one seal sheet in order to produce plural seals from one seal sheet. Also, for the production of plural seals, 16 to 30 seals, for example, from one seal sheet of the kind, it is known to perforate the seal sheet along the size of each seal to be peeled off. Also, it is generally practiced to select and execute the aforesaid edit or process by the designation through his key entry or the like by the user.

However, the user may wrongly select the kind of recording sheet to be used or wrongly execute the edit or the process or he may execute recording without recognizing the kind of recording sheets stored in a sheet feed cassette that supplies recording sheets. In such case, some other images, which are not suitable for the seal formation, may be recorded while seal sheets are stored in the sheet feed cassette or a larger image may be recorded against a perforated seal sheet. Thus, the seal sheets which are more expensive than ordinary sheets are consumed wastefully after all.

Also, for the recording apparatus capable of using recording sheets of various sizes, there is a problem that a smaller image is recorded on a sheet whose size is larger than that of the target image eventually.

SUMMARY OF THE INVENTION

The present invention is designed in consideration of the problems discussed above.

It is an object of the invention to provide a recording apparatus capable of recording without recording improperly any smaller images that may be unfit for the size of the recording sheet or staining the platen even when the recording medium and the ink sheet installed thereon are different in its sizes or the user does not designate the size of the recording medium to be used, and also, to provide a recording method and a storage medium therefor.

In accordance with the present invention, it becomes possible to record the image that has been adjusted to the size and kind of a recording sheet and the size of the recording sheet corresponding to the ink sheet without the user's complicated operation, hence reducing the possibility that an image of wrong size is recorded or the platen and others in the interior of the apparatus are stained.

A recording apparatus of the present invention, which uses an ink sheet having ink of plural colors coated sequentially thereon and transfers ink to a recording medium for recording in accordance with image data, is capable of recording on a plurality of recording media having different sizes, and being capable of using selectively plural ink sheets corresponding to the plural recording media of different sizes, respectively. This recording apparatus comprises:

- means for detecting the size of a recording medium to detect the size of the recording medium to be used for recording;
- means for detecting the size of an ink sheet to detect the size of a recording medium corresponding to the ink sheet to be used for recording; and
- controlling means to control the recording operation in accordance with the size of the detected recording medium and the size of the recording medium corresponding to the detected ink sheet.

Also, a recording apparatus of the present invention comprises means for carrying to carry a recording medium; means for carrying to carry the ink sheet having ink of plural colors being sequentially coated thereon; and a recording head for transferring ink on the ink sheet to the recording medium, and recording the image by transferring ink to the recording medium by driving the recording head in accordance with image data. This recording apparatus is capable of recording on a plurality of recording media having different sizes, and being capable of using selectively plural ink sheets corresponding to the plural recording media of different sizes, respectively. This recording apparatus further comprises:

- means for detecting the length of a recording medium to detect the length of the carrying direction of the recording medium used for recording by the carrying means;
- means for detecting the size of an ink sheet to detect the size of a recording medium corresponding to the ink sheet to be used for recording; and
- controlling means to control the recording operation in accordance with the length of the recording medium detected by the means for detecting the length of a recording medium and the size of the detected recording medium corresponding to the detected ink sheet.

In accordance with the present invention, there is provided a recording method for a recording apparatus which is provided with carrying means to carry a recording medium, carrying means to carry the ink sheet having ink of plural colors coated sequentially thereon, and a recording head for transferring ink of the ink sheet to the recording medium, and records images by transferring ink to the recording medium by driving the recording head in accordance with image data. This recording method comprises the steps of:

- determining the size of a recording medium to determine the size of the recording medium used for recording;
- detecting the size of ink sheet to detect the size of the recording medium corresponding to the ink sheet used for recording; and
- controlling the recording operation in accordance with the determined size of the recording medium and the size of the recording medium corresponding to the detected ink sheet.

Also, in accordance with the present invention, a storage medium is arranged to store the program for implementing the recording method referred to in the preceding paragraph.

Also, a recording apparatus of the present invention, which comprises means for carrying to carry a recording medium, means for carrying to carry the ink sheet having ink of plural colors being sequentially coated thereon, and a recording head for transferring ink on the ink sheet to the recording medium, and records the image by transferring ink to the recording medium by driving the recording head in accordance with image data, is capable of recording on a plurality of recording media having different sizes, being capable of using selectively plural ink sheets corresponding to the plural recording media of different sizes, respectively. This recording apparatus comprises:

means for outputting information to indicate the contents of the operation regarding a recording operation;

means for determining to determine at least either one of the size of a recording medium used for recording and the size of the recording medium corresponding to the ink sheet used for recording;

means for controlling to change the contents of indication by the outputting means in accordance with the result of determination by the determining means.

Also, in accordance with the present invention, there is provided a recording method for a recording apparatus which is provided with carrying means to carry a recording medium; carrying means to carry the ink sheet having ink of plural colors coated sequentially thereon; and a recording head for transferring ink of the ink sheet to the recording medium, and records images by transferring ink to the recording medium by driving the recording head in accordance with image data. This recording method comprises the steps of:

determining at least either one of the size of a recording medium used for recording and the size of the recording medium corresponding to the ink sheet used for recording; and controlling the output to change the contents displayed on the indication unit in accordance with the result of the determination in the determination step Also, a storage medium is arranged to store the program to implement the recording method referred to in the preceding paragraph.

Other objectives and advantages besides those discussed above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

BRIEF DESCRIPTION OF THE DRAWINGS

FIGS. 5A and 5B are views which illustrate images to be recorded in specific formulas.

FIG. 6 is a flowchart which shows the control flow of the recording apparatus represented in FIG. 4.

FIGS. 10A, 10B and 10C are views which schematically shows the editing screen.

DETAILED DESCRIPTION OF THE PREFERRED EMBODIMENTS

Hereinafter, the detailed description will be made of the embodiments in accordance with the present invention.

In this respect, the present invention is not necessarily limited to the recording apparatus, but it may be possible to implement the invention by a recording method, and further, in the form of a storage medium, such as a CD-ROM or a floppy disc.

First Embodiment

Now, with reference to the accompanying drawings, the detailed description will be made of a first embodiment in accordance with the present invention.

The first embodiment hereof is arranged to provide a recording apparatus capable of executing the recording operation appropriately without recording an image whose size is made improperly larger than the recording sheet even when the size of the recording sheet used for recording and the size of the corresponding ink sheet are different, and also, this embodiment provides a recording method therefor.

Figure 1:
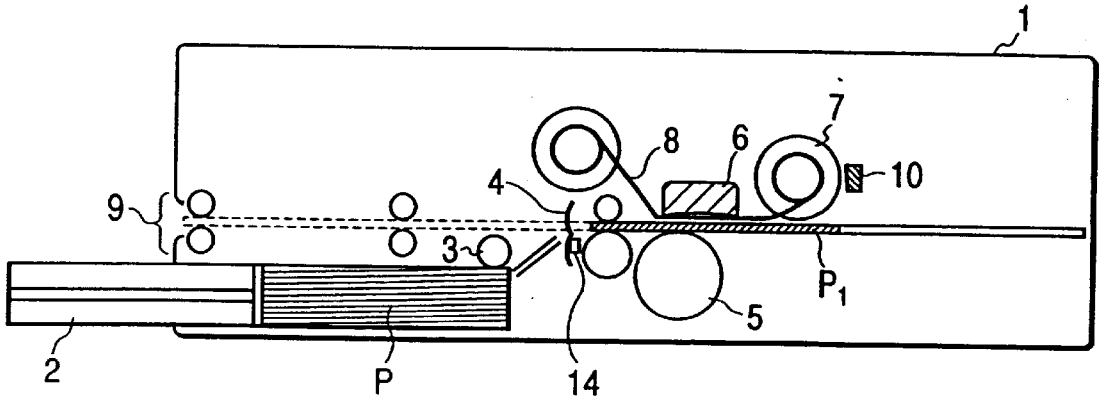
FIG. 1 is a cross-sectional view which shows the principal structure of a recording apparatus in accordance with a first embodiment of the present invention.

FIG. 1 is a cross-sectional view which shows the principal structure of a recording apparatus in accordance with a first embodiment of the present invention.

Figure 2A:
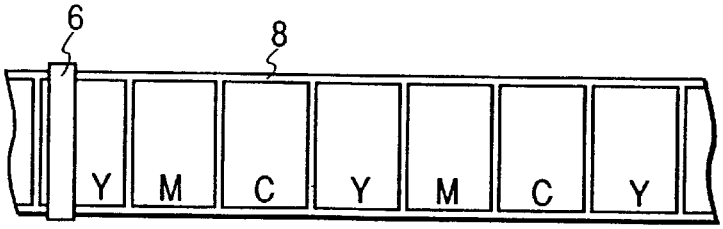
FIGS. 2A, 2B, 2C and 2D are views which illustrate recording sheets of different sizes and ink sheets each corresponding to the recording sheets of different sizes.

At first, the description will be made of the entire structure of the recording apparatus. Each one of recording sheets P is carried separately from a sheet cassette 2 having the recording sheets P stored in it to a apparatus main body 1 by means of a sheet feed roller 3. At the same time, the recording sheet P is pinched by a pair of carrier rollers 4 to make its reciprocation possible to and from the recording unit. In the recording unit, a platen roller 5 and a thermal head 6 which gives heat in accordance with recording information are arranged to face each other with the carrier path of the recording sheet between them. Then, each of ink sheets 8 having thermal fusion or thermal sublimation ink coated on them, which are stored in an ink sheet cassette (may be referred to as an ink cassette) 7, is pressed to the recording sheet P by means of the thermal head 6. At the same time, the heat generating devices of the thermal head 6 are selectively heated to record the required images on the recording sheet P. As shown in FIG. 2A, each ink portion of yellow (Y), magenta (M), and cyan (C) is coated sequentially on the ink sheet 8 substantially in the same size as the recording sheet P shown in FIG. 2B. When each one of these colors is transferred, the recording sheet P is returned to a position P1 where the recording is initiated. Thus, such recording is made one after another by the ink portion corresponding to each color. In this manner, the recording sheet P reciprocates by use of the pair of the carrier rollers 4 in the same numbers as those of colors. Lastly, the recording sheet is guided to a pair of exhaust rollers 9 to be exhausted outside of the apparatus, hence completing the current recording.

Figure 2B:
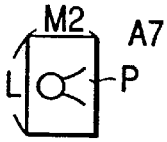
Figure 2C:
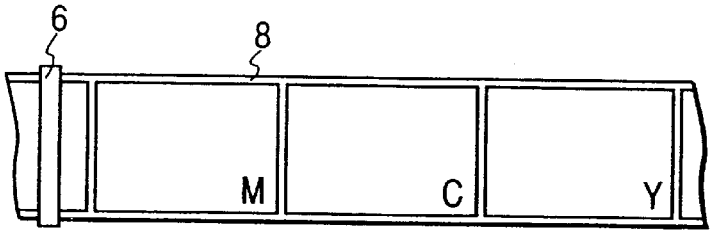
Figure 2D:
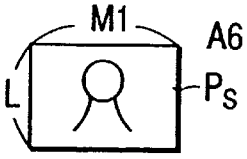

As represented in FIG. 1, each of the recording sheets P stored in the sheet cassette 2 is, as shown in FIG. 2B, in the A-7 size which is approximately a half of A-6 size recording sheet Ps shown in FIG. 2D. However, the position (indicated by solid lines) before recording in the case of the A-6 size (indicated by solid lines), and the position immediately after the recording (indicated by broken lines) are also represented in FIG. 1.

FIG. 2B shows the recording sheet P of A-7 size. FIG. 2D shows the recording sheet Ps of A-6 size. Therefore, the recording sheet P shown in FIG. 2B has a size which is a half the recording sheet Ps as shown in 2D. Hereinafter, the recording sheet Ps may also be referred to as the standard size, while the recording sheet P as the half size.

In this respect, the description will be made on the assumption that the pixel numbers recorded on the recording sheet of the A-7 size are (M2×L), and that the pixel numbers recorded on the recording sheet Ps of the A-6 size are (M1×L). Here, it is defined that L>M2, M1>L and, at the same time, L is the pixel numbers that can be recorded by means of the heat generating devices of the thermal head 6.

FIG. 2A shows an ink sheet that corresponds to the recording sheet P of A-7 size shown in FIG. 2B. FIG. 2C shows an ink sheet that corresponds to the recording sheet Ps of A-6 size shown in FIG. 2D.

As shown in FIGS. 2A to 2D, it is necessary to use the ink sheets having the ink portions whose sizes correspond respectively to that of the recording sheets. In other words, it is fundamentally required to use the recording sheets and the ink sheet cassettes correspondingly in terms of the sizes thereof. To this end, the recording apparatus shown in FIG. 1 is provided with a sensor 10 to discriminate the kinds of the ink sheet cassettes. For the recording sheets, it is more reliable fundamentally if the sheet cassettes are arranged each per sheet size, thus making the discrimination easier. However, with costs in view, it is generally practiced to arrange a guide plate 11 which is movable along a guide groove 12 and set by the user in accordance with the kind of the recording sheet to be used for the current operation.

Figure 3:
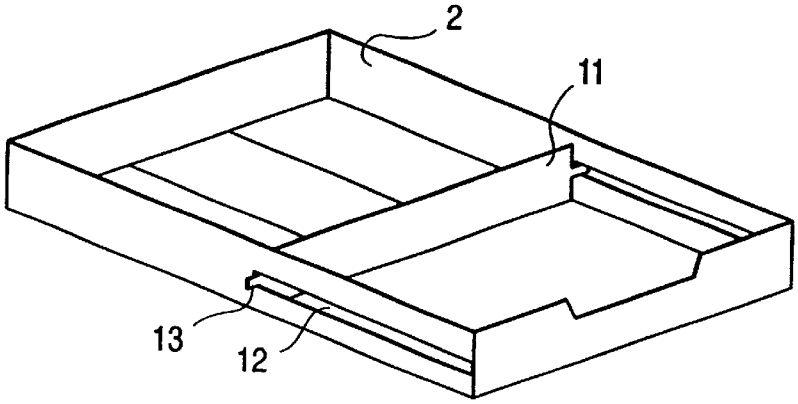
FIG. 3 is a perspective view which shows the structure of a cassette formed to supply recording sheets.

In FIG. 1, there is no representation of the detection sensor for the size of each recording sheet. For example, however, it is possible to detect the size of the recording sheet by detecting the presence or absence of an edge portion 13 of the guide plate 11 shown in FIG. 3 which is movable along the guide groove 12. In this case, if the user forgets setting the guide plate 11 when he sets the recording sheets of A-7 size, which is a half the size of the standard sheet, there is the problem of erroneous recognition that the ink sheet cassette for the A-6 standard size has been set. Here, when the recording sheet is carried provisionally to the position P1 for initiating the current recording, the length of the recording sheet in use can be measured by measuring the time or the like required for the recording sheet to pass a leading end detection sensor 14. Therefore, it is possible to discriminate the difference of the size of the ink sheet cassette for the A-7 recording sheet and exhaust the recording sheet immediately, thus avoiding the erroneous recording.

Figure 4:
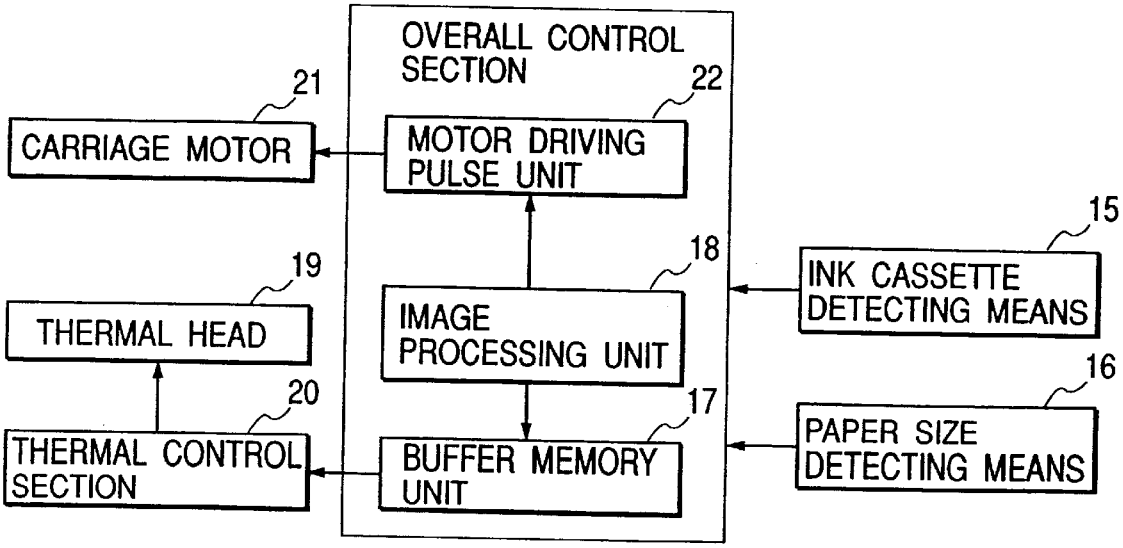
FIG. 4 is a block diagram which shows a recording apparatus and the principal structure of the control unit of the recording apparatus.

As shown in FIG. 4, the image control unit comprises means 15 for detecting an ink sheet cassette; means 16 for detecting the size of a recording sheet; a buffer memory 17; an image processing unit 18 for executing the reduction or enlargement of an image, the rotation thereof, or the like; a thermal head 19; a thermal control unit 20 therefor; a carrier motor 21; and a driving control pulse generation unit 22.

With the recording apparatus thus structured, the inputted image can be edited to provide an image form having the optimal size and direction for recording without any particular entry of the size of the recording sheet for the current recording, because both the kinds of the recording sheet and ink sheet cassette currently installed on the recording apparatus can be determined by the output contents of the detection means 15 and 16.

More specifically, when an image of A-6 size should be recorded, the intended recording is executed as it is if the size of the recording sheet is as shown in FIG. 2D, and the size of the ink sheet is as shown in FIG. 2C, which indicates that both of them are of the A-6 size identically. However, if the combination of the recording sheet and ink sheet is such as those shown in FIG. 2B and FIG. 2C or FIG. 2D and FIG. 2A, which indicates that either one of them is different at least with respect to the size or the direction, a warning is issued or an error message is indicated, hence prohibiting the execution of recording process.

After that, if the recording sheet is replaced from the A-6 size to the set of the A-7 (half size) which makes it possible to perform recording faster at lower costs (that is, the combination of those shown in FIG. 2A and FIG. 2B), the recording apparatus automatically resizes (modification of image size) and changes the direction of recording (executes the image rotation process) in accordance with information from the recording size detection means 16 based on the image information of the A-6 size.

Now, with reference to a flowchart shown in FIG. 6, the description will be made of the resizing process whereby to modify the image sizes and the image rotation process thereby to convert the length and breadth (which may be referred to as "length and breadth conversion process").

At first, the recording sheets are discriminated in step S1.

Here, the recording sheets usable for the recording apparatus shown in FIG. 1 are not necessarily limited to the paper sheets whose sizes are different as shown in FIG. 2B and FIG. 2D, but the transfer sheet is also useable, with which an image can be transferred to some other medium by use of a heating equipment such as an iron. When recording is performed on such transfer sheet as this, the transferred image is inverted. Therefore, the recorded image should be converted into its mirror image.

As to the recording sheet discrimination in the step S1, it is determined whether the size is A-7 like the recording sheet P shown in FIG. 2B or A-6 like the recording sheet P, shown in FIG. 2D. At the same time, it is determined whether or not the current sheet is a transfer sheet. Also, for the transfer sheet, it is determined whether it is of the A-6 size or of the A-7 size. The discrimination of the recording sheets is possible by use of the sheet feed cassettes 2 as to the sizes thereof. The discrimination of whether it is an ordinary sheet or a transfer sheet is possible in accordance with the user's key entry through an operation unit (not shown). The method of recording sheet determination is not necessarily limited to those described above. It may be possible to arrange the structure so that both the sizes and kinds of recording sheets are determined in accordance with the designation made by the user.

In accordance with the results of discrimination in step S1, a flag flg_sheet is set as given below to indicate the kind and size of the recording sheet.

| | |
|---|---|
| Ordinary sheet of A-6 size | f1g_sheet = 0 |
| Ordinary sheet of A-7 size | f1g_sheet = 1 |
| Transfer sheet of A-6 size | f1g_sheet = 2 |
| Transfer sheet of A-7 size | f1g_sheet = 3 |

Here, the description will be made on the assumption that the pixel number indicated by the image data used for recording is m×n. Also, the pixel number required for recording per recording sheet is M1×L (M1>L) as described earlier in the case of A-6 size (flg_sheet=0 or flg_sheet=2) or it is M2×L (L>M2) in the case of A-7 size (flg_sheet=1 or flg_sheet=3).

In step S2, the process is executed to obtain the enlargement (reduction) factor h in the resizing process whereby to modify the size of an image. Here, the description will be made of a case where the size is modified so that no image is made larger than the recording sheet currently in use for any one of images irrespective of its aspect ratio.

The enlargement (reduction) factor h in the resizing process is arranged to adopt the pixel numbers required for recording, as well as the smaller factor of the respective ratios of the sizes in the length and the breadth of the original image. In other words, it is assumed that when the flg_sheet=0 or 2, h=(the smaller one of M1/m and L/n), and when the flg_sheet=1 or 3, h=(the smaller one of M2/n and L/m). By the adoption of the smaller factor for the ratios in the length and breadth, it becomes possible to record an image without making it larger than the recording sheet irrespective of its aspect ratio.

Then, in step S3, the resizing process, and the image rotation process whereby to convert the length and breadth of the image are executed. The pixel position of the original image is indicated by the (x, y), and the pixel position of the resized image is indicated by the (X, Y). Also, the value of the position (x, y) of the original image is defined as f(x, y), and the value of the position (X, Y) of the resized image is defined as g(X, Y). Then, the resizing is executed using the following formula:

$$g(X,Y)=f(x,y) \text{ in the case of (flg_sheet=0)}$$

$$g(X,Y)=f(m-y,x) \text{ in the case of (flg_sheet=1)}$$

$$g(X,Y)=f(m-x,y) \text{ in the case of (flg_sheet=2)}$$

$$g(X,Y)=f(x,y) \text{ in the case of (flg_sheet=3)}$$

However, x=[X/h], y=[Y/h] (where [a] is the largest integer which does not exceed a) or $0 \leqq X \leqq [hm]$, $0 \leqq Y \leqq [hn]$.

With the execution of the above processes, it becomes possible to perform an appropriate recording without any special operation made by the user even when combination is improper between the size of an image to be recorded and that of the recording sheet set for the recording apparatus, and the size of the ink sheet to be used.

Also, as shown in FIGS. 5A and 5B, it becomes possible to automatically record the same image in a specific form in multiple frames if the length of a recording sheet, such as a seal sheet having half perforations 23 as shown in FIG. 5A, is modified from the A-7 size as shown in FIG. 5A so that such recording sheet is arranged to be a (specific) size which is dedicated for the intended use, and then, such dedicated size is arranged to be detectable by use of the detection means 16 or the leading end detection sensor 14.

As described above, in accordance with the present embodiment, it is possible to operate recording corresponding to the respective sizes of recording sheet and ink sheet without the user's special operation to modify the size of an image and execution of the image rotation process thereof. It is also possible to automatically suspend the operation if the recording is not executable due to the improper size of the recording sheet mounted on the recording apparatus. Therefore, there is no possibility that recording sheets and ink sheets are consumed wastefully, and that the interior of the apparatus is stained by ink. Further, by use of a recording sheet of a specific size, it becomes possible to record automatically in a specific form on a recording sheet, such as a plurality of the image which is smaller than the size of the recording sheet.

As described above, in accordance with the present invention, it is possible to record corresponding to the sizes of a recording sheet and ink sheet without any complicated operation to be executed by the user. Also, in a case where the intended recording is impossible due to the erroneous setting of the sizes of a recording sheet and ink sheet, a warning is issued before initiating such recording operation or the recording sheet is exhausted without recording. As a result, an appropriate recording is possible at all the time, and there is no possibility that an improperly smaller image is recorded on a recording sheet or an image is recorded in a form larger than the recording sheet currently in use so that it exceeds the recordable area of the recording sheet to stain the interior of the recording apparatus.

Figure 7:
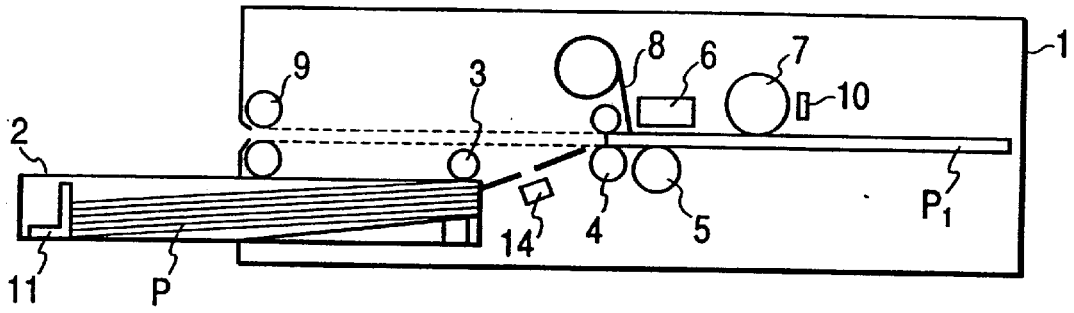
FIG. 7 is a cross-sectional view which shows the principal structure of the recording apparatus in accordance with a second embodiment of the present invention.

FIG. 7 is a cross-sectional view which shows the structure of a recording apparatus which is applicable to the present embodiment. The same reference numerals are applied to the same constituents shown in FIG. 1. Now, at first, the entire structure of the recording apparatus will be described. Each one of the recording sheets P is carried separately from the sheet cassette 2 having the recording sheets P stored in it to the apparatus main body 1 by means of the sheet feed roller 3. At the same time, the recording sheet is pinched by a pair of the carrier rollers 4 to make its reciprocation possible to and from the recording unit. In the recording unit, the platen roller 5 and the thermal head 6 which gives heat in accordance with recording information are arranged to face each other with the carrier path of the recording sheet between them. Then, each of the ink sheets 8 having thermal fusion or thermal sublimation ink coated on them, which are stored in the ink sheet cassette 7, is pressed to the recording sheet P by means of the thermal head 6. At the same time, the heat generating devices of the thermal head 6 are selectively heated to transfer and record the required images on the recording sheet P. The ink sheet 8 which has been described earlier is such that each ink portion of yellow (Y), magenta (M), and cyan (C) is coated sequentially almost in the same size as the recording sheet P. After each one color of them is transferred, the recording sheet P is returned to the position P1 where the recording is initiated. Thus, recording is made one after another by the ink portion corresponding to each color. In this manner, the recording sheet P reciprocates by means of the pair of the carrier rollers 4 in the same numbers as those of colors. Lastly, the recording sheet is guided to a pair of the exhaust rollers 9 to be exhausted outside of the housing, hence completing the current recording.

Figure 8A:
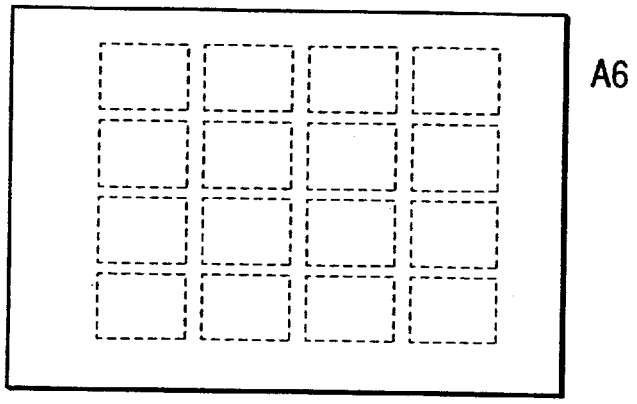
FIGS. 8A and 8B are views which illustrate the sizes of recording sheets.
Figure 8B:
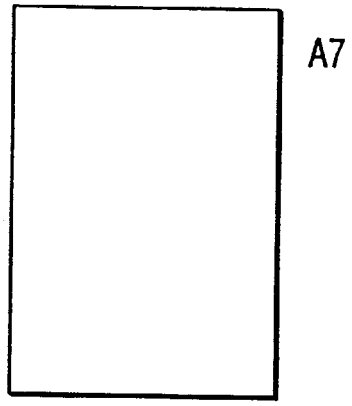

The recording sheets P stored in the cassette 2 vary such as the A-6 size (postcard size) as shown in FIG. 8A, the A-7 size which is approximately a half thereof as shown in FIG. 8B, and the panorama size (not shown) whose length is two times the length of the one shown in FIG. 8A.

It is necessary to change the size of the ink sheet 8 in the longitudinal direction of each ink portion thereof so as to make it agreeable with the size of the recording sheet P. In other words, the recording sheet and the ink cassette where ink sheets are stored should be used in a pair fundamentally. To this end, the recording apparatus shown in FIG. 7 is provided with the sensor 10 to discriminate the kinds of the ink sheet cassettes 7. For the recording sheets, it is more reliable fundamentally if the sheet cassettes are arranged each per sheet size, thus making the discrimination easier. However, with costs in view, it is generally practiced to arrange the guide plate 11 which is movable along the guide groove and set by the user in accordance with the kind of the recording sheet to be used for the current operation. In FIG. 7, there is no representation of the detection sensor for the size of each recording sheet. For example, however, it is possible to detect the size of the recording sheet by detecting the presence or absence of the edge portion of the guide plate 11 which is movable along the guide groove (not shown). In this case, if the user forgets setting the guide plate 11 when he sets the recording sheets of A-7 size, which is a half the size of the standard sheet, a problem is encountered, provided that the ink sheet cassette for the A-6 standard size has been set. Here, when the recording sheet P1 is carried provisionally to the position P1 for initiating the current recording, the length of the recording sheet P in use can be measured by measuring the time or the like required for the recording sheet P to pass the leading end detection sensor 14. Therefore, it is possible to discriminate the difference of the size of the ink sheet cassette before recording is initiated and exhaust the recording sheet, thus avoiding the erroneous recording.

Figure 9:
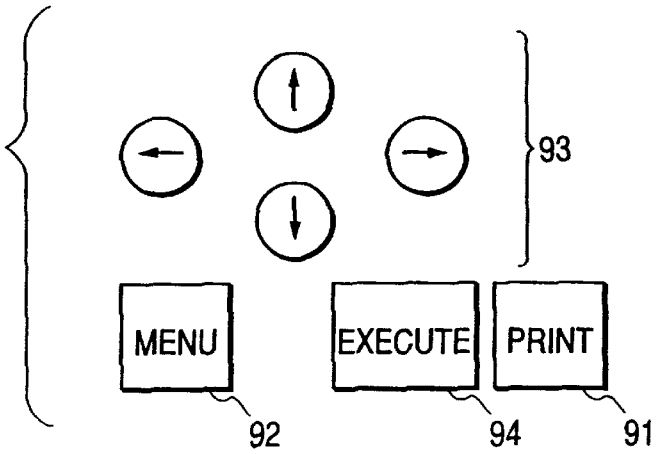
FIG. 9 is a view which schematically shows the arrangement of keys in the operation unit provided for a recording apparatus.

FIG. 9 and FIGS. 10A to 10C are views which illustrate the structure related to the operation unit. FIG. 9 shows the arrangement of operational keys. FIG. 10 shows the editing screen. When recording the inputted target image, a print key 91 of the operational keys shown in FIG. 9 is depressed to execute it. If an edit is necessary, a menu key 92 in FIG. 9 is depressed to call the menu screen as shown in FIG. 10A. Then, selection is made by means of four arrow keys 93 shown in FIG. 9 as needed, and determined by depressing the execution key 94. Of the contents of the menu shown in FIG. 10A, the numeral 1 designates the setting of the "printed numbers of sheets", and the [1] is the default setting which indicates one sheet. With the selection of the [N] by use of the key "→" of the arrow keys 93, the numeral can advance beginning with 2. Then, when the desired number appears, the execution key 94 is depressed to determine the printed numbers of sheet for execution. The numeral 2 indicated on the menu shown in FIG. 10A designates the selection of the "multiple screen", which makes it possible to select 2 screens, 4 screens, 9 screens, or the like for the number of images to be recorded from one recording sheet. If the seal sheet, such as shown in FIG. 8A, which is divided by perforations, 16 screens can be selected to make each image usable as a seal. The numeral 3 designates the "image to be inlaid" which is prepared for use of superimposition in advance. With the selection of [yes], it is possible to select one inlayer image from among several kinds of images for synthesizing use (not shown) which are prepared for the production of seal sheets. The numeral 4 designates the selection of "panoramic image", which makes it possible to record on the panorama sheet by synthesizing a plurality of sheets having on them the images which have been continuously photographed (not shown). the numeral 5 designates the "title phrase" such as "A Merry Christmas" "A Happy New Year" or some other specific expression which is prepared in advance for use of superimposition for the standard postcard size. The numeral 6 designates the "image quality adjustment". If this designation is selected with "yes" mark, it becomes possible to adjust the contrast, darkness of colors, or the like. These have been one example. It may be possible to provide many other selections, such as frames for use of superimposition, patterns of famous sites and landscapes, special effects or the like.

Figure 11:
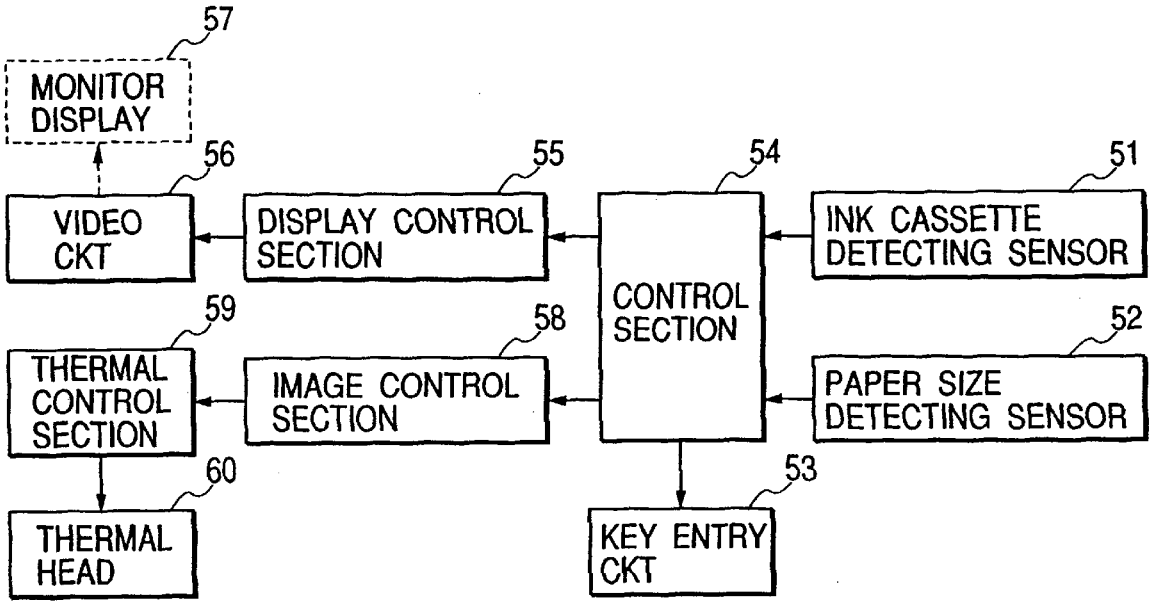
FIG. 11 is a block diagram which shows the principal structure of the recording apparatus in accordance with the second embodiment of the present invention.

As shown in FIG. 11, the control system that deals with the above operations comprises an ink cassette detection sensor 51; a recording sheet size detection sensor 52; a key entry circuit 53; a control unit 54 of these sensors and circuit; a video output circuit 56; a monitor display indicator 57; an image control unit 58, a thermal head 60, and a thermal control unit 59.

Here, if the seal sheet of the standard size coated with adhesive agent, which is formed to be partly peeled off for its adhesion to some other object, is installed on the recording apparatus, while the ink cassette for A-6 seal sheet use is set as the ink cassette 7, the detection of A-6 size is made by use of the recording sheet size sensor 52, and also, the detection of the ink cassette for use of A-6 seal sheet is made by use of the ink cassette detection sensor 52. Consequently, then, the menu is indicated on the display as shown in FIG. 10B. On the menu shown in FIG. 10B, only the framed items are effective, and, for example, only such portion is indicated by solid line or by the reversed characters, while the other portions are indicated by broken line or the like to make its selections impossible. Here, the multiple screen selection is restricted to the 16 screens so that the number 16 is automatically set if this is selected. Also, the next item, that is, the image for inlaying use, may be used for recording as it is without being superimposed in some cases, but it is mostly used for the superimposition. Therefore, the screen which is used in this respect is assumed to be the one immediately before the execution button is depressed. Also, it is arranged to display the information that indicates the seal sheet at A in FIG. 10B in accordance with the discriminating signals from the ink cassette detection sensor 51 which may sense the respective ink ribbon marks for determination as shown in FIG. 11.

Also, if, for example, the ordinary sheet of A-6 size is set in the recording apparatus, while the ink cassette for use of ordinary sheet of A-6 size as the ink cassette 7, the A-6 size is detected by use of the recording sheet size sensor 52, and the ink cassette for use of the ordinary sheet which corresponds to the A-6 size is detected by use of the ink cassette detection sensor 51. Consequently, then, the printed numbers of sheet, the multiple screen, the title phrase, and the image quality adjustment are indicated on the menu. Thus, whereas the "title phrase" is made selective, it becomes impossible to select the "image to be inlaid", and then, the information of the "full size" is indicated at A in FIG. 10B.

FIG. 10C shows the edit screen when the half size recording sheet, which is illustrated in FIG. 8B, is set, and also, the ink cassette for the half size use is set. In this case, since the recording sheet is small, it automatically becomes impossible to select the multiple screen, the title phrase, or the like. Only the limited items are indicated, and the information that indicates the "half size" appears at A in FIG. 10C.

For the above embodiment, it is assumed that the seal sheet is mainly used as the A-6 size sheet, and the seal sheet cannot be sensed directly. Therefore, there is a drawback that the edit screen for use of sheet is not displayed even when the seal sheet is set if the ink cassette is for the use of the ordinary sheet.

To cope with this drawback, therefore, it is arranged to make the size of the seal sheet of A-6 size slightly longer in its length for the formation of a specially-sized sheet, hence making it possible for the recording sheet size detection sensor to sense such seal sheet directly. In this way, the seal sheet is detected by the recording sheet size detection sensor, and it is arranged to illuminate the item indications on the seal sheet edit screen if the seal sheet is detected by use of the ink cassette detection sensor. It may also be arranged to blink the item indications on the seal sheet edit screen to issue warning if the seal sheet is set but not the ink cassette for use of the seal sheet and vice versa. For the combination which causes this blinking, a fairly good image is still obtainable, although it is impossible to obtain the optimal one. Therefore, it may be possible to ignore such warning.

Also, for a simplified system, it may be possible to determine the item indications on the edit screen depending only on the detection output of the recording sheet size detection sensor. In this case, when the A-6 size is detected, such menu that contains the printed numbers of sheet, the multiple screen, the title phrase, the image quality adjustment is indicated on the display. When a special A-6 size is detected, the aforesaid menu for use of the seal sheet is indicated on it. When the panorama size is detected, such menu that contains the printed numbers of sheet, the panorama, the title phrase, and the image quality adjustment is indicated on it. When the A-7 size is detected, the menu which is represented in FIG. 10C is indicated on it, that is, the printed numbers of sheet, and the image quality adjustment.

In this way, as regards the images inputted into the recording apparatus, it is made possible to select the size of the recording sheet installed on the recording apparatus or only the items that can be edited to obtain the image mode adjust to the kind of the ink cassette without manually inputting the size of the sheet on which to record the images. Hence, it becomes easier to record the images adjusted to match the size and kind of a recording sheet. In this respect, it is of course possible for the present invention to arrange the variations of its embodiment in accordance with various sizes of the recording sheet and the particularity of the sheet to be used.

Also, the recording sheet and the ink cassette are used correspondingly in a proper combination. It is, therefore, desirable to detect both the kind of the recording sheet and the size of the ink cassette in order to prevent them from being used in a wrong combination. It is of course possible to execute the operation in accordance with the result of the detection of either one of them. Since it costs more to provide detection means for both of them, the manufacture costs of the apparatus can be suppressed by the implementation of the present invention with only one of the detection means.

What is claimed is:

1. A recording apparatus comprising means for carrying to carry a recording medium, means for carrying to carry an ink sheet having ink of plural colors sequentially coated thereon, and a recording head for transferring ink on said ink sheet to said recording medium, and said apparatus recording the image by transferring ink to said recording medium by driving said recording head in accordance with image data, said apparatus being capable of recording on a plurality of recording media having different sizes, and being capable of using selectively plural ink sheets corresponding to the plural recording media of different sizes, respectively, said apparatus comprising:

means for outputting information to indicate the contents of the operation regarding a recording operation;

means for determining to determine at least either one of the size of the recording medium used for recording and the size of the recording medium corresponding to the ink sheet used for recording; and means for controlling to change the contents of indication by said outputting means in accordance with the result of determination by said determining means;, wherein said outputting means outputs information to be indicated by using equipment connected with said recording apparatus, and said outputting means outputs information to display a screen regarding the contents of the operation, and wherein said controlling means controls the output of said outputting means to indicate the contents regarding the recording operation executable corresponding to the size of the recording medium or the size of the recording medium corresponding to the ink sheet in accordance with the result of the determination.

2. A recording apparatus according to claim 1, wherein said outputting means outputs the contents to be indicated on an indication means of the equipment externally connected with said recording apparatus, and said outputting means outputs information to display an editing screen regarding the contents of the operation, on said indication means.

3. A recording apparatus according to claim 1, further comprising:

means for detecting the length of the recording medium to detect the length of said recording medium in the carrying direction of said carrying means, wherein said determination means determines the size of said recording medium in accordance with the detected length of the recording medium.

4. A recording apparatus according to claim 1, further comprising:

a sheet feed unit for containing said recording medium, said sheet feed unit being provided with a movable member shiftable to a position corresponding to the size of said recording medium to be contained, and the user being able to shift said movable member, wherein said determination means determines the size of said recording medium in accordance with the position of said movable member.

5. A recording apparatus according to claim 4, wherein said sheet feed unit is in the mode of a cassette detachably mountable on the recording apparatus.

6. A recording apparatus according to claim 1, wherein each area of the region having ink of each color coated thereon of said plural ink sheets is different in accordance with the size of the recording medium corresponding thereto.

7. A recording apparatus according to claim 1, wherein said ink sheet is in the mode of an ink sheet cassette containing ink sheets and arranged to be detachably mountable on said recording apparatus, and said determination means determines the size of the ink sheet in accordance with the condition of said ink sheet cassette.

8. A recording apparatus according to claim 1, further comprising:

means for processing image data to execute an editing process of said image data, said means for processing image data arranging a plurality of images processed by an image size reduction process, said controlling means controls the output of said outputting means to indicate the contents for executing the recording operation to record by arranging a plurality of same images on the recording medium using said means for processing image data when the size of the determined recording medium or the recording medium corresponding to the determined ink sheet is a specific size.

9. A recording apparatus according to claim 1, wherein ink coated on said ink sheet has a property of being sublimated when thermal energy is applied.

10. A recording apparatus according to claim 1, wherein ink coated on said ink sheet has a property of being fused when thermal energy is applied.

11. A recording method for a recording apparatus which is provided with carrying means to carry a recording medium, carrying means to carry an ink sheet having ink of plural colors coated sequentially thereon, and a recording head for transferring ink of said ink sheet to said recording medium, and records images by transferring ink to the recording medium by driving said recording head in accordance with image data, said recording method comprising the steps of:

determining at least either one of the size of the recording medium used for recording and the size of the recording medium corresponding to the ink sheet used for recording; and controlling the output to change the contents displayed on equipment externally connected with said recording apparatus in accordance with the result of the determination in said determination step;

wherein said step of controlling output outputs information to be displayed on the equipment connected with said recording apparatus, and said step of controlling output outputs information to display a screen for the contents of the operation, and wherein, based on the result of determination, said step of controlling output controls the output to the equipment externally connected with said recording apparatus for displaying the contents of the recording operation executable in accordance with the size of the recording medium or the size of the recording medium corresponding to the ink sheet.

12. A recording method according to claim 11, wherein said step of controlling output outputs the contents to be displayed on an indication unit of the equipment externally connected with said recording apparatus, and said step of controlling output outputs information to display an editing screen for the contents of the operation, on said indication unit.

13. A recording method according to claim 11, further comprising the step of:

determining the size of the recording medium in accordance with the length of the detected recording medium in said determination step comprising the step of carrying the recording medium and the step of detecting the length of the recording medium in said carrying direction.

14. A recording method according to claim 11, wherein said determination step determines the size of the recording medium in accordance with a position of a movable member of a sheet feed unit provided for the recording apparatus, said movable member being shiftable to a position corresponding to the size of the recording medium contained in said sheet feed unit, and the user being able to shift said movable member.

15. A recording method according to claim 14, wherein said sheet feed unit is in the mode of a cassette detachably mountable on the recording apparatus.

16. A recording method according to claim 11, wherein said ink sheet is in the mode of an ink sheet cassette having the ink sheet contained therein, being detachably mountable on said recording apparatus, and said determination step determines the size of the ink sheet in accordance with the condition of said ink sheet cassette.

17. A recording method according to claim 11, further comprising the step of:

processing image data to execute an editing process of said image data prior to the recording operation, said step of processing image data arranging a plurality of images processed by an image size reduction process, wherein said step of controlling controls the output to display the contents of the execution of the recording operation to record by arranging a plurality of same images on the recording medium in said step of processing image data when the size of the detected recording medium is a specific size.

18. A recording method according to claim 17, wherein said step of processing image data can execute enlargement and reduction processes to change the size of image to be recorded in accordance with the image data, and the image rotation process to change the directions of the image.

19. A recording method according to claim 11, wherein ink coated on said ink sheet has a property of being sublimated when thermal energy is applied.

20. A recording method according to claim 11, wherein ink coated on said ink sheet has a property of being fused when thermal energy is applied.

* * * * *